US009550089B2

(12) United States Patent
Tseng

(10) Patent No.: US 9,550,089 B2
(45) Date of Patent: Jan. 24, 2017

(54) EXERCISE MACHINE WITH POWER SUPPLIER

(71) Applicant: Dyaco International Inc., Taipei (TW)

(72) Inventor: Ghun-Kai Tseng, Taipei (TW)

(73) Assignee: Dyaco International Inc., Taipei (TW)

( * ) Notice: Subject to any disclaimer, the term of this patent is extended or adjusted under 35 U.S.C. 154(b) by 62 days.

(21) Appl. No.: 14/700,046

(22) Filed: Apr. 29, 2015

(65) Prior Publication Data

US 2016/0256731 A1 Sep. 8, 2016

(30) Foreign Application Priority Data

Mar. 2, 2015 (TW) ..... 104106537 A

(51) Int. Cl.

| | |
|---|---|
| ***A63B 21/015*** | (2006.01) |
| ***A63B 22/06*** | (2006.01) |
| ***A63B 69/16*** | (2006.01) |
| ***A63B 21/22*** | (2006.01) |
| ***A63B 21/00*** | (2006.01) |
| ***A63B 23/04*** | (2006.01) |

(52) U.S. Cl.

CPC ..... *A63B 21/225* (2013.01); *A63B 21/00192* (2013.01); *A63B 21/015* (2013.01); *A63B 21/4034* (2015.10); *A63B 21/4049* (2015.10); *A63B 22/0605* (2013.01); *A63B 22/0664* (2013.01); *A63B 23/0476* (2013.01)

(58) Field of Classification Search

CPC ... A63B 21/0055; A63B 21/22; A63B 21/225; A63B 22/06; A63B 22/0605; A63B 22/0664; A63B 22/0694; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; B62M 3/02; B62M 3/04; B62M 3/06

See application file for complete search history.

(56) References Cited

U.S. PATENT DOCUMENTS

| | | | | |
|---|---|---|---|---|
| 3,789,696 A * | 2/1974 | Beam, III | ..... | B62M 3/02 280/261 |
| 5,743,834 A * | 4/1998 | Rodgers, Jr. | ..... | A63B 22/001 482/51 |
| 6,084,325 A * | 7/2000 | Hsu | ..... | A63B 21/0051 188/161 |
| 7,018,324 B1 * | 3/2006 | Lin | ..... | A63B 21/0052 188/158 |
| 7,481,749 B1 * | 1/2009 | Chen | ..... | A63B 21/0051 482/57 |

(Continued)

FOREIGN PATENT DOCUMENTS

| | | | | |
|---|---|---|---|---|
| GB | 2460238 A * | 11/2009 | ..... | A63B 21/00181 |

*Primary Examiner* — Joshua Lee

(74) *Attorney, Agent, or Firm* — Donald E. Stout; Stout, Uxa & Buyan, LLP

(57) ABSTRACT

An exercise machine comprises a resistance device and a power supplier. The resistance device provides a resistance and comprises an axle. The power supplier comprises one or more conducting rings arranged at a side or respectively arranged at a side of the resistance device. The conducting rings are coaxially coupled with the axle and are capable of rotating about the axle.

6 Claims, 9 Drawing Sheets

(56) References Cited

U.S. PATENT DOCUMENTS

| | | | | |
|---|---|---|---|---|
| 7,504,737 | B2 * | 3/2009 | Vasilovich | A63B 21/0053 290/1 C |
| 7,670,267 | B2 * | 3/2010 | Wang | A63B 22/001 482/52 |
| 8,062,188 | B1 * | 11/2011 | Chien | A63B 22/0664 482/51 |
| 8,328,692 | B2 * | 12/2012 | Lin | A63B 21/0052 482/1 |
| 8,957,641 | B1 * | 2/2015 | Hsu | A63B 21/0051 322/4 |
| 2003/0003776 | A1 * | 1/2003 | Lohr | H04L 25/0266 439/1 |
| 2006/0250753 | A1 * | 11/2006 | Lui | A63B 22/0015 361/600 |
| 2007/0238580 | A1 * | 10/2007 | Wang | A63B 22/001 482/52 |
| 2009/0170661 | A1 * | 7/2009 | Hsiao | A63B 21/0051 482/2 |
| 2011/0111922 | A1 * | 5/2011 | Weinman | A63B 21/0053 482/2 |
| 2011/0234175 | A1 * | 9/2011 | Hajee | A63B 21/0053 320/164 |
| 2012/0217758 | A1 * | 8/2012 | Chen | A63B 21/0053 290/1 C |
| 2012/0238410 | A1 * | 9/2012 | Magakat | B62M 3/00 482/57 |
| 2014/0243171 | A1 * | 8/2014 | Huang | A63B 21/225 482/118 |

* cited by examiner

1

EXERCISE MACHINE WITH POWER SUPPLIER

CROSS-REFERENCE TO RELATED APPLICATIONS

The entire contents of Taiwan Patent Application No. 104106537, filed on Mar. 2, 2015, from which this application claims priority, are expressly incorporated herein by reference.

BACKGROUND OF THE INVENTION

1. Field of the Invention

The present invention relates to an exercise machine, and more particularly relates to an exercise machine providing power supplier.

2. Description of Related Art

Various exercise machines, such as elliptical trainers, steppers, or stationary bikes, typically have a driving wheel. The user of the exercise machine exerts a force to the driving wheel via hands or feet, so that different muscles can be built.

For different sizes of users or different training intensities, the exercise machines usually employ an adjustment mechanism to adjust positions. This can typically be done by an electrically-driven device. However, the layout of the power supply to the electrically driving device will be a problem to be resolved due to the space limitation or operation of components or due to other reasons.

SUMMARY OF THE INVENTION

In one general aspect, the present invention relates to an exercise machine, and more particularly relates to an exercise machine with power supplier.

In an embodiment of the present invention, an exercise machine is provided with a resistance device and a power supplier. The resistance device provides a resistance for the user and comprises an axle. The power supplier comprises a first conducting ring arranged at a side of the resistance device. The first conducting ring is coaxially coupled with the axle and is capable of rotating about the axis.

In an embodiment, each conducting ring further comprises a connector, and the connector comprises two contacts to respectively contact the first electrode ring and the second electrode ring.

In an embodiment, the exercise machine further comprising two cranks respectively arranged at a side of the resistance device, wherein each crank has an end to couple with the axle, and a portion of a user exerts a force to the crank and makes the crank to rotate about the axle.

In an embodiment, the resistance device comprises a driving wheel and a magnetic flywheel.

DETAILED DESCRIPTION OF THE INVENTION

Figure 1:
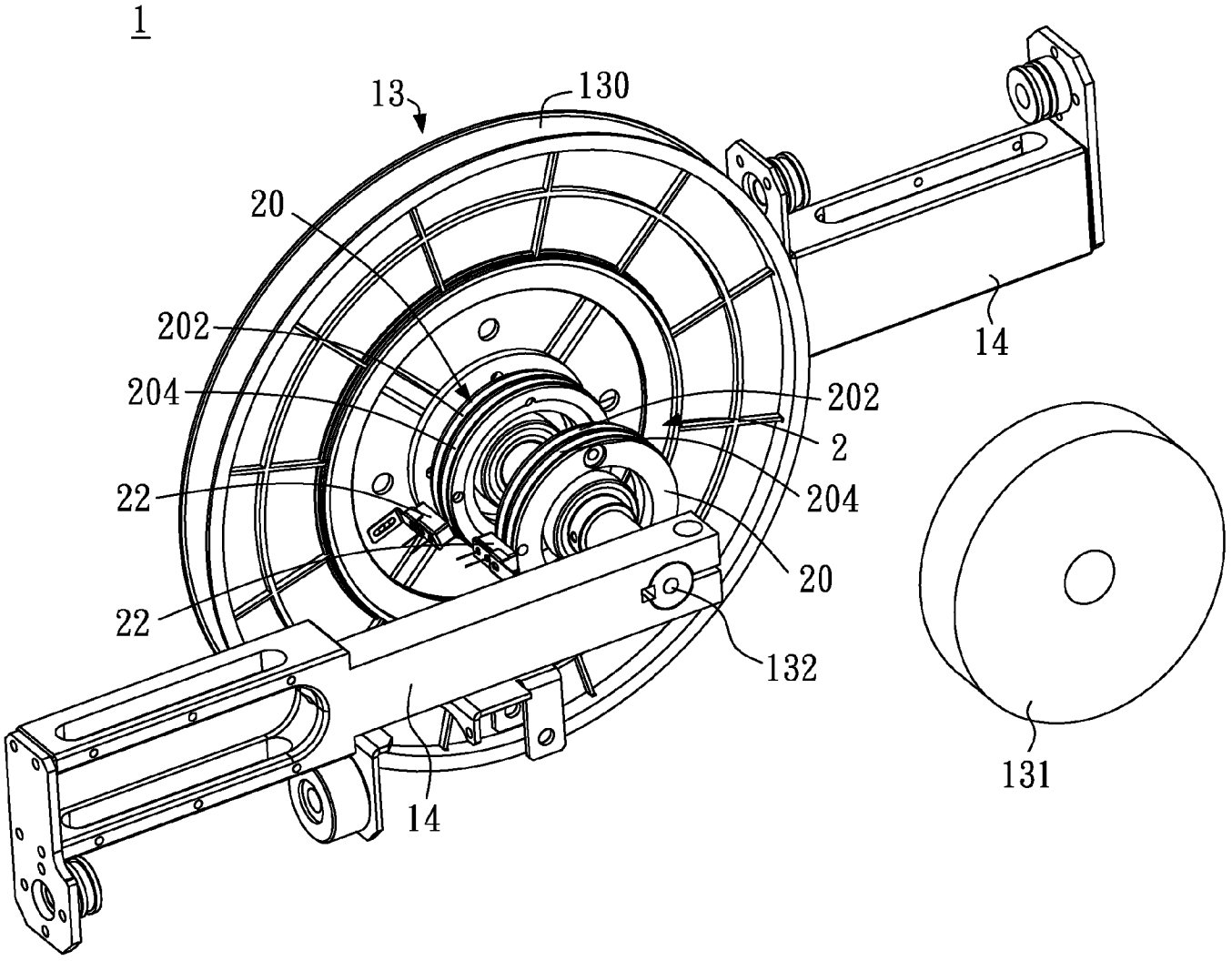
FIG. 1 is a perspective view showing an exercise machine with a power supplier in accordance with a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

FIG. 1 is a perspective view showing an exercise machine 1 with a power supplier 2 in accordance with a preferred embodiment of the present invention. The exercise machine 1 comprises a resistance device 13 for providing a resistance for the user. The exercise may be, but is not limited to, an elliptical trainer, a stepper, or a stationary bike, or other machine providing a resistance via flywheel. In this preferred embodiment, the exercise machine 1 is an elliptical trainer.

Figure 9:
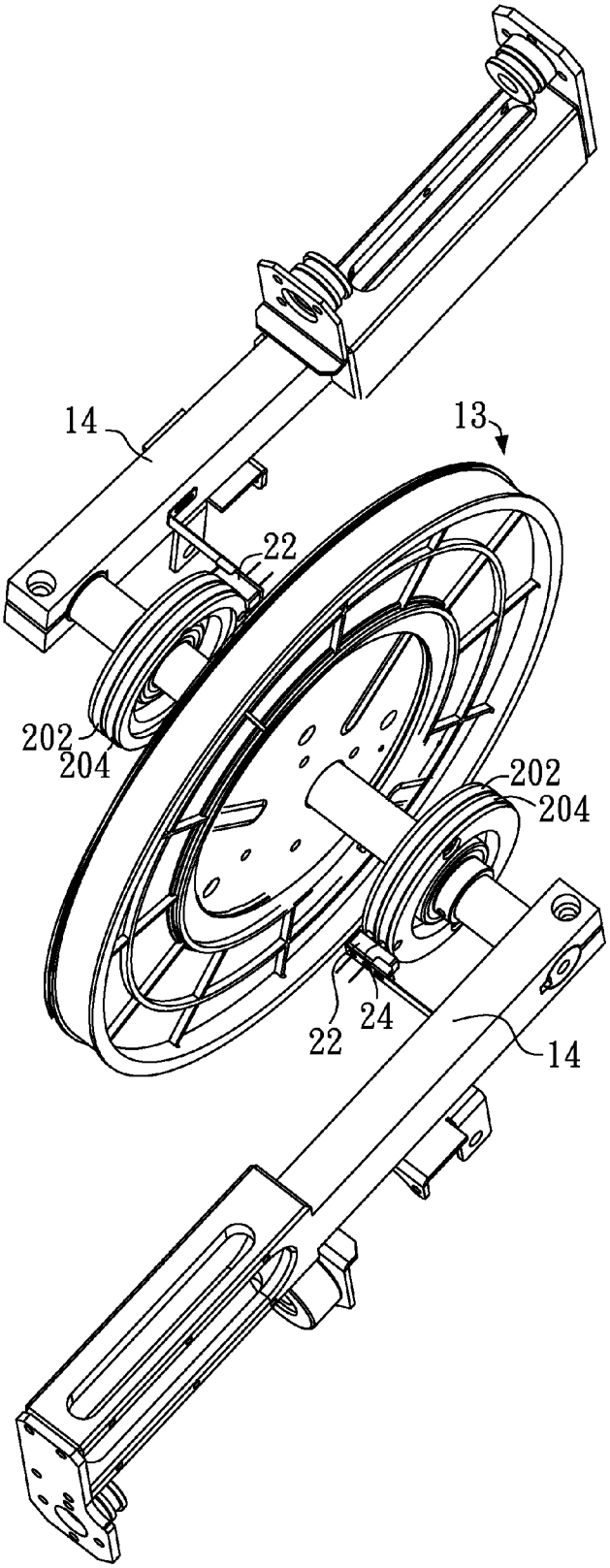
FIG. 9 is a perspective view showing a power supplier according to another embodiment of the present invention.

In addition, the power supplier 2 comprises one or more conducting rings 20 arranged at a side or respectively arranged at a left side and a right side of the resistance device 13. In this preferred embodiment, the power supplier 2 comprises two conducting rings 20 and both of them are arranged at a same side of the resistance device 13. In another embodiment, the power supplier 2 merely comprises a conducting ring arranged at a side of the resistance device 13. Referring to FIG. 9, in another embodiment the power supplier 2 comprises two conducting rings 20 arranged at a left side and a right side of the resistance device 13, respectively.

Referring to FIG. 1, preferably, the resistance device 13 may comprise, but is not limited to, a driving wheel 130 and a magnetic flywheel 131 movably coupled with the driving wheel 130. A user of the exercise machine 1 can exert a force to the driving wheel 130 so as to drive it to rotate. The magnetic flywheel 131 provides an adjustable resistance to the user via the driving wheel 130. In another embodiment of this invention, the resistance device 13 may comprise merely a wheel 130 with magnets arranged within or near the wheel 130, so that the wheel 130 itself can provide an adjustable resistance. In this preferred embodiment, the resistance device 13 comprises an axle 132 arranged at the driving wheel 130, and the conducting rings 20 are coaxially coupled with the axle 132, so that the conducting ring 20 can rotate about the axle 132.

In addition, the exercise machine 1 may comprise two cranks 14 respectively arranged at a side of the resistance device 13, and each crank 14 has an end coupling to the axle 132. The user utilizes hands or foot or other portion to exert a force to the cranks 14, so that the cranks 14 rotate about the axle 132. In this preferred embodiment, the conducting rings 20 and driving wheel 130 are synchronously rotated about the axle 132. In another embodiment, the conducting rings 20 and driving wheel 130 are rotated about the axle 132 but they are not synchronous.

Figure 2:
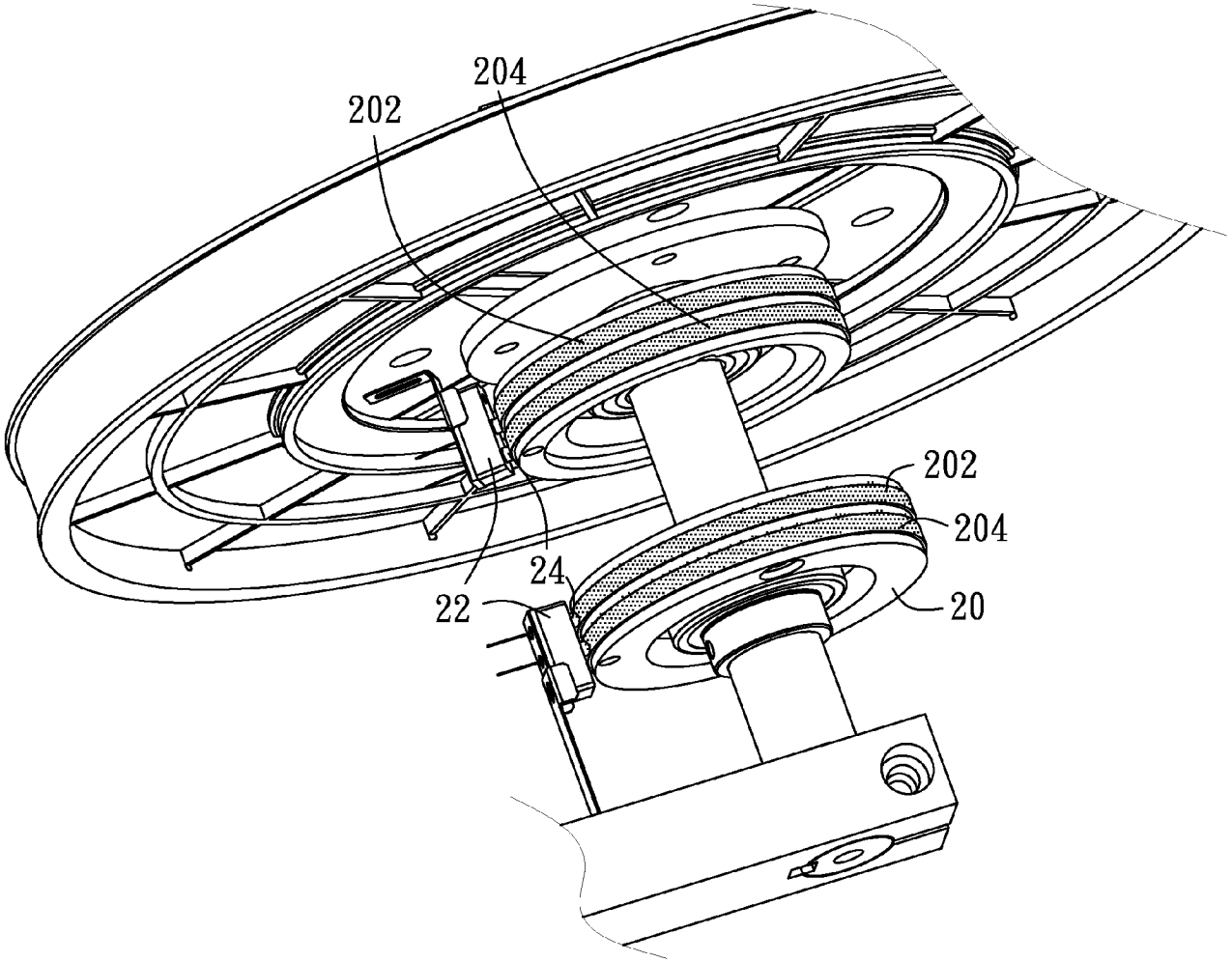
FIG. 2 is a partially enlarged view showing the exercise machine and the power supplier of FIG. 1.

FIG. 2 is a partially-enlarged view showing the power supplier of FIG. 1. Referring to FIGS. 1 and 2, each conducting ring 20 comprises a first electrode ring 202 and a second electrode ring 204, such as a positive electrode ring 202 and a negative electrode ring 204, and both of them are made of a conductive material or metal and are electrically connected with the power of the exercise machine 1.

Referring to FIGS. 1 and 2, the power supplier 2 may comprise one or more connectors 22, and each connector 22 comprises two contacts 24 respectively contacting the first electrode ring 202 and the second electrode ring 204. In addition, the exercise machine 1 comprises one or more driving mechanism, or one or more sensors or electronic devices needing electricity, and the one or more driving mechanism or one or more sensors or electronic devices are electrically connected with the conducting rings 20 via the connectors 22.

Figure 3:
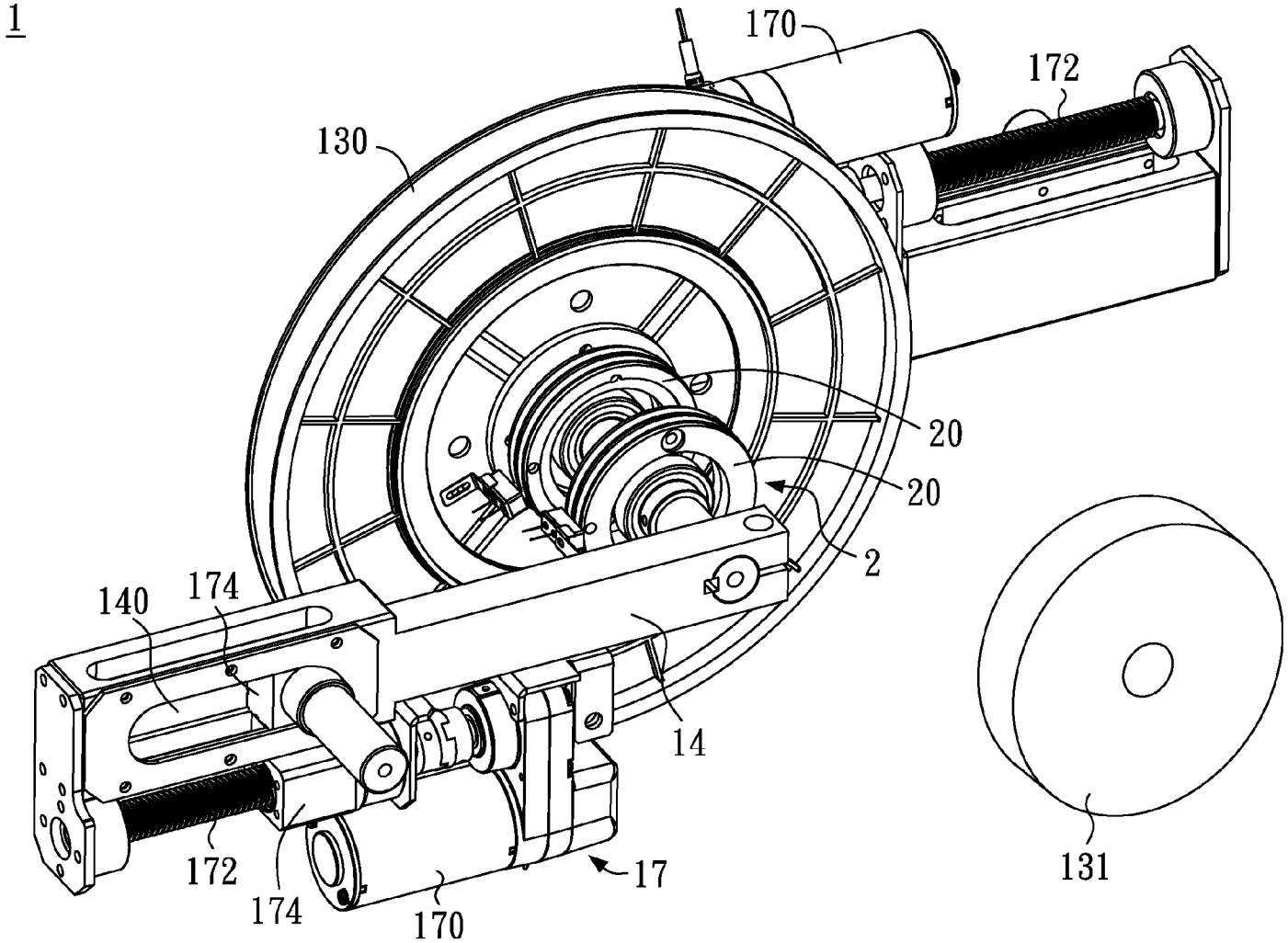
FIGS. 3 and 4 are perspective views showing another exercise machine with a power supplier according to another embodiment of the present invention.
Figure 4:
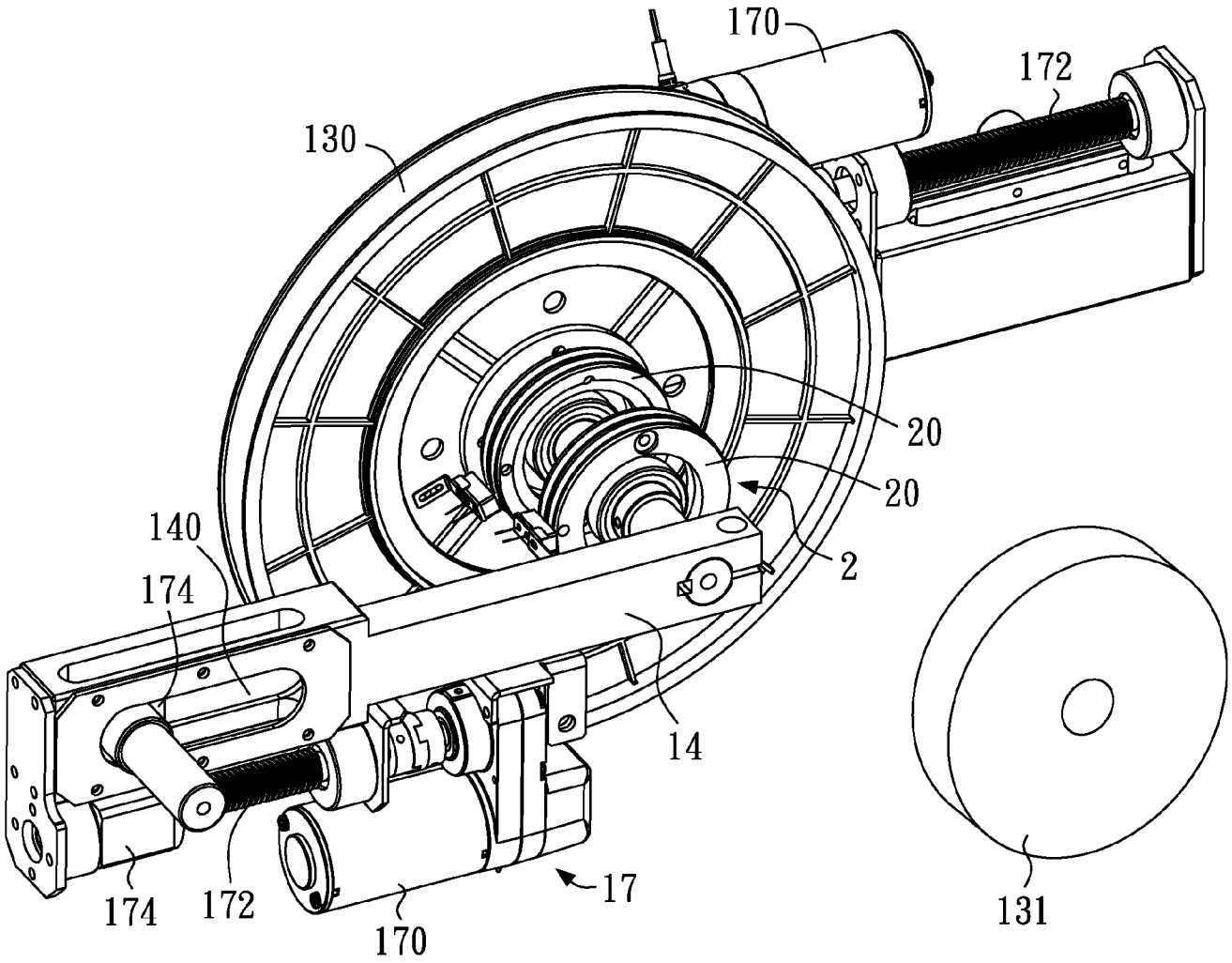

FIGS. 3 and 4 are perspective view showing an exercise machine 1 with the power supplier 2 according to an embodiment of the present invention. In this embodiment, the two cranks 14 are respectively arranged at a side of the resistance device 13 and respectively couples with an adjusting mechanism 17, so as to adjust the effective length of the cranks 14. And the two adjusting mechanisms 17 are electrically connected with a conducting ring 20, respectively.

Referring to FIG. 3, each adjusting mechanism 17 comprises a motor 170, a screw, and a block 174. The motor 170 can drive the screw 172 to rotate, and the block 174 has internal thread to engage the screw 172. When the screw 170 is driven to rotate, the block 174 is moved along the screw 172 in a direction toward or away the motor 170.

Referring to FIG. 3, in addition, each crank 14 may comprise a recess 140, and a portion of the block 174 is extended into the recess 140, so that the block 174 can be moved within the recess 140. As shown in FIG. 3, when the motor 170 drives the screw 172 to rotate, the block 174 is moved toward the motor 170, and therefore the effective length of the crank 14 is decreased. As shown in FIG. 4, when the motor 170 drives the screw 172 to rotate, the block 174 is moved away the motor 170, and therefore the effective length of the crank 14 is increased.

Figure 5:
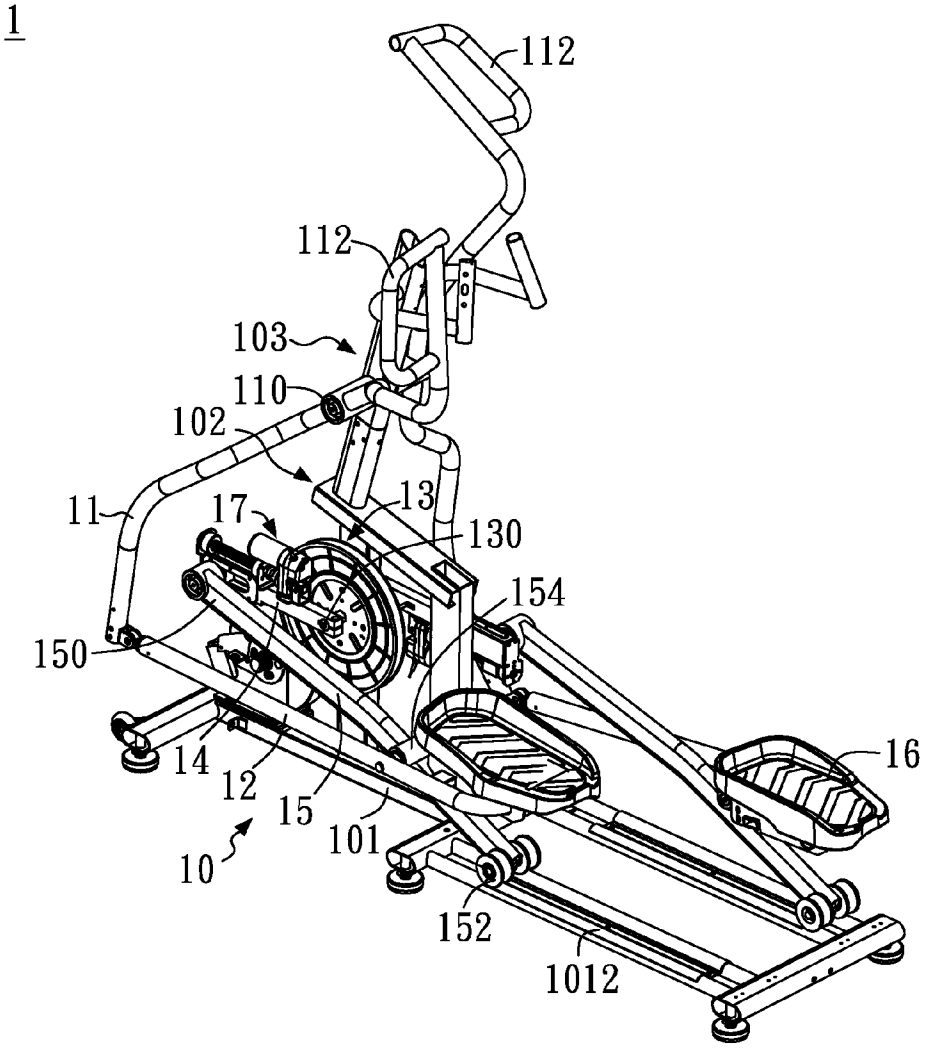
FIG. 5 is a perspective view showing that the power supplier of FIG. 3 is applied to an exercise machine.

FIG. 5 is a perspective view showing that the power supplier 2 of FIGS. 3 and 4 is applied to an exercise machine 1, such as an elliptical trainer 1, so as to adjust its moving track.

Referring to FIG. 5, the exercise machine 1(elliptical trainer 1) comprises a frame 10, two swing arms 11, two link arms 12, a resistance device 13, two cranks 14, two supporting arms 15, and two pedals 16. In this embodiment, the frame 10 may comprise, but is not limited to, a base 101, a supporting structure 102, and a post 103. The base 101 is against a supporting plane or ground. The supporting structure 102 is arranged above the frame 101, and the post 103 is arranged above the supporting structure 102. For illustrative purpose, the post 103 includes two ends, in which one end couples to the supporting structure 102, and the other end couples to a control interface (not shown). The exercise machine 1 can be controlled by the control interface.

Referring to FIG. 5, both the two swing arms 11 and the two link arms 12 are respectively arranged at a side of the supporting structure 102. Each swing arm 11 comprises a pivot portion 110 coupling to the supporting structure 102, so that the swing arm 11 can be moved fore and aft. In addition, each swing arm 11 includes two ends, in which one end couples to a handle 112 to be held by the user, and the other end couples to an end of a corresponded link arm 12, and the other end of the corresponded link arm 12 couples to a corresponded pedal 16.

Modifications, variations, and equivalents may be made for the above embodiment. For example, in another embodiment, the axle 132 is arranged at the magnetic flywheel 131, and the conducting rings 20 are coaxially coupled with the axle 132, so that the conducting ring 20 can rotate about the axle 132.

Figure 6:
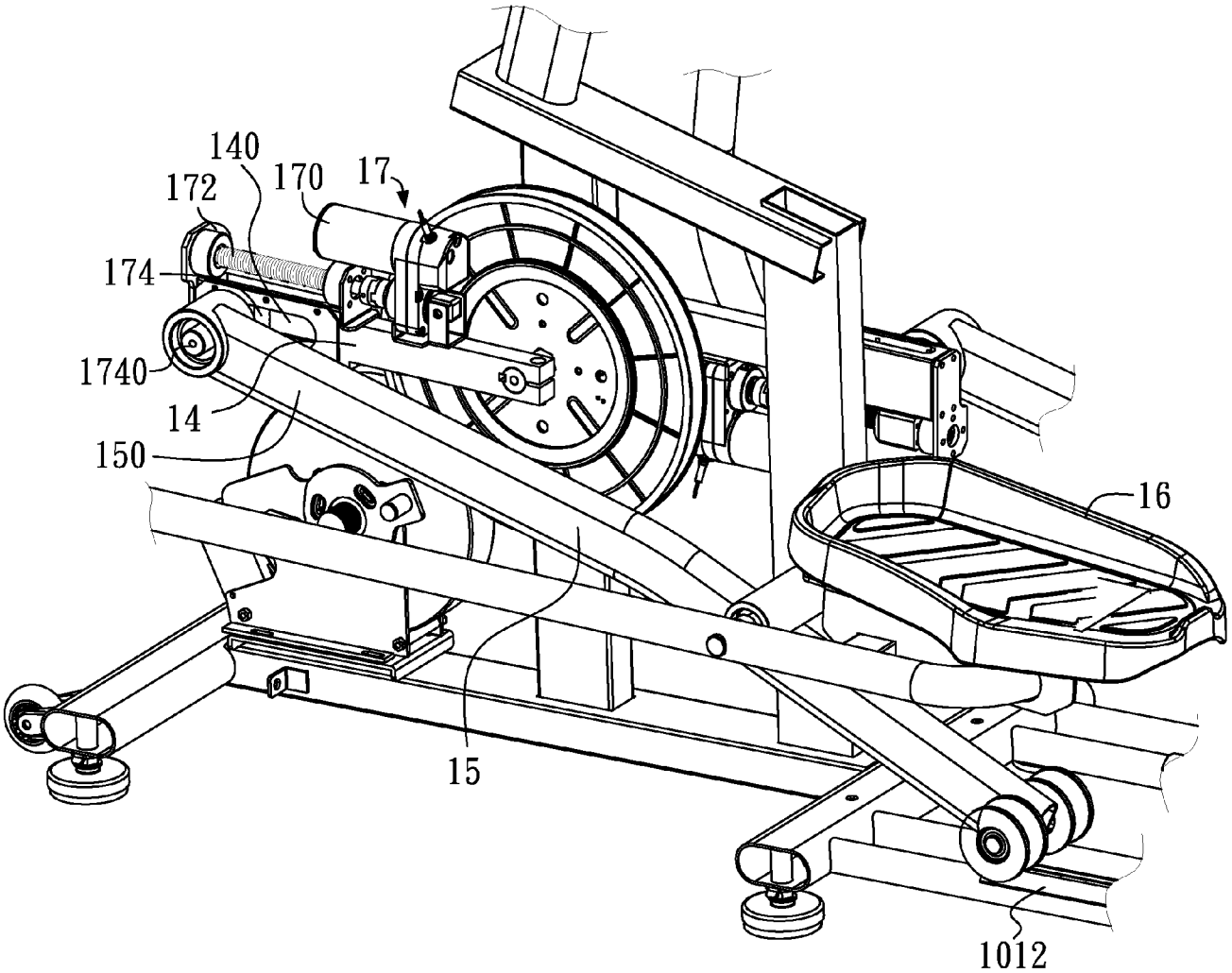
FIG. 6 is a partially-enlarged perspective view showing that the power supplier of FIG. 3 is applied to an exercise machine.
Figure 7:
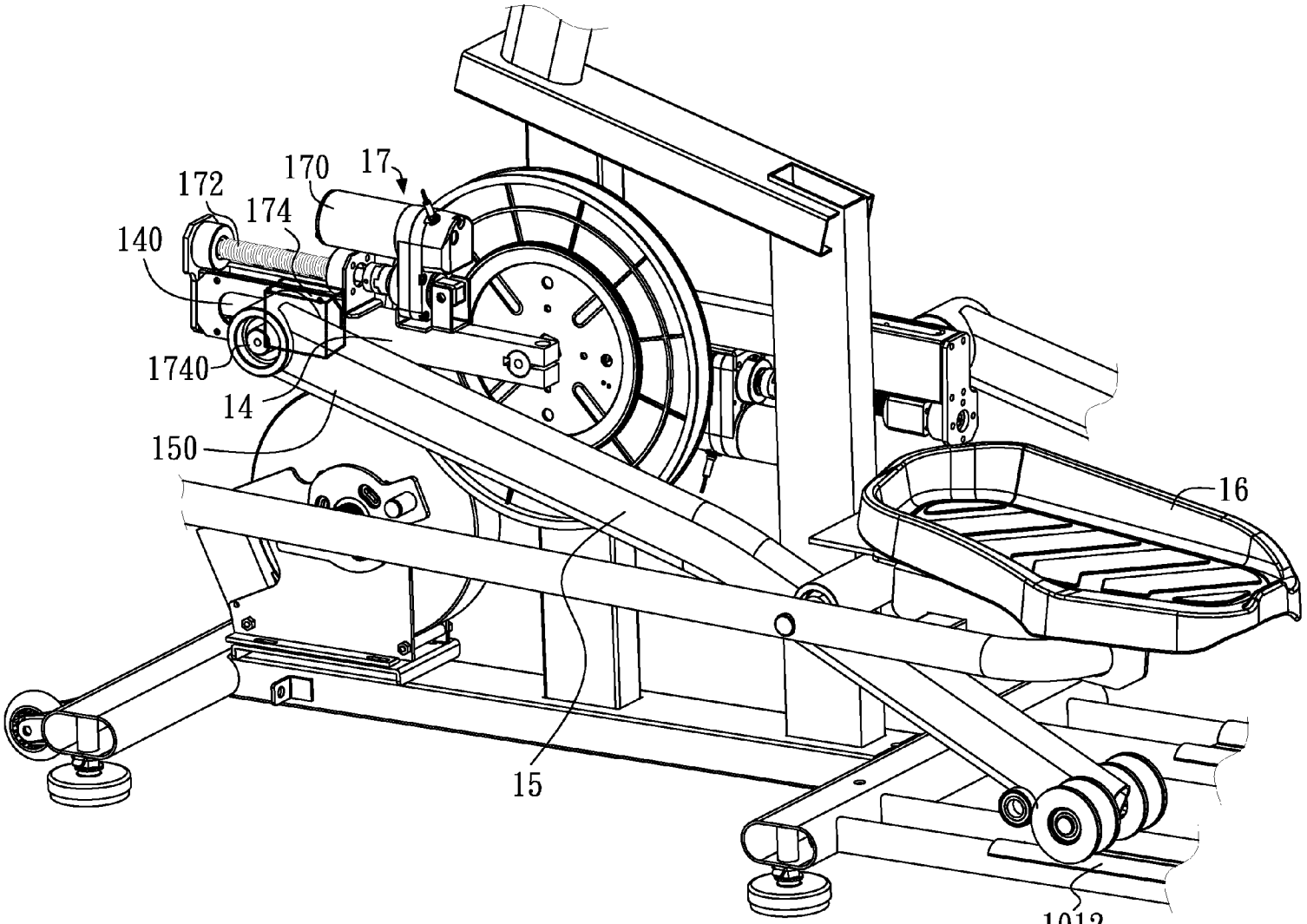
FIG. 7 is a partially-enlarged perspective view showing that the power supplier of FIG. 3 is applied to an exercise machine.

FIGS. 6 and 7 are partially enlarged views of exercise machine of FIG. 5. Referring to FIG. 6, the resistance device 13 may be arranged at the supporting structure 102 and provides a resistance. The two cranks 14 are respectively arranged at a side of the resistance device 13. The resistance device 13 includes an axle 132, and each crank 14 has an end to couple the axle 132. In addition, a front end 150 of the supporting arm 15 has a pivot axis 1740 pivotally connected with the block 174. A rear end of the supporting arm 15 has a sliding portion 152, such as a wheel 152, to slide on a track 1012 of the base 101. Furthermore, each supporting arm 15 has a supporting portion 154 coupling to a corresponded pedal 16, and the supporting portion 154 pivotally connects with a portion of a corresponded link arm 12. Accordingly, the rotation of the crank 14 about the axle 132 will make the pedal 16 moving along an elliptical or an elliptical-like path, and the sliding portion 152 of the supporting arm 15 moving along a reciprocal path on the track 1012.

Referring to FIG. 6, when the motor 170 drives the screw 172 to rotate and thus make the block 174 moving away the motor 170, the effective length of the crank 14 will be increased and thus the elliptical path of the pedal 16 will be enlarged. Referring to FIG. 7, when the motor 170 drives the screw 172 to rotate and thus make the block 174 moving toward the motor 170, the effective length of the crank 14 will be decreased and thus the elliptical path of the pedal 16 will be shrunk.

Figure 8:
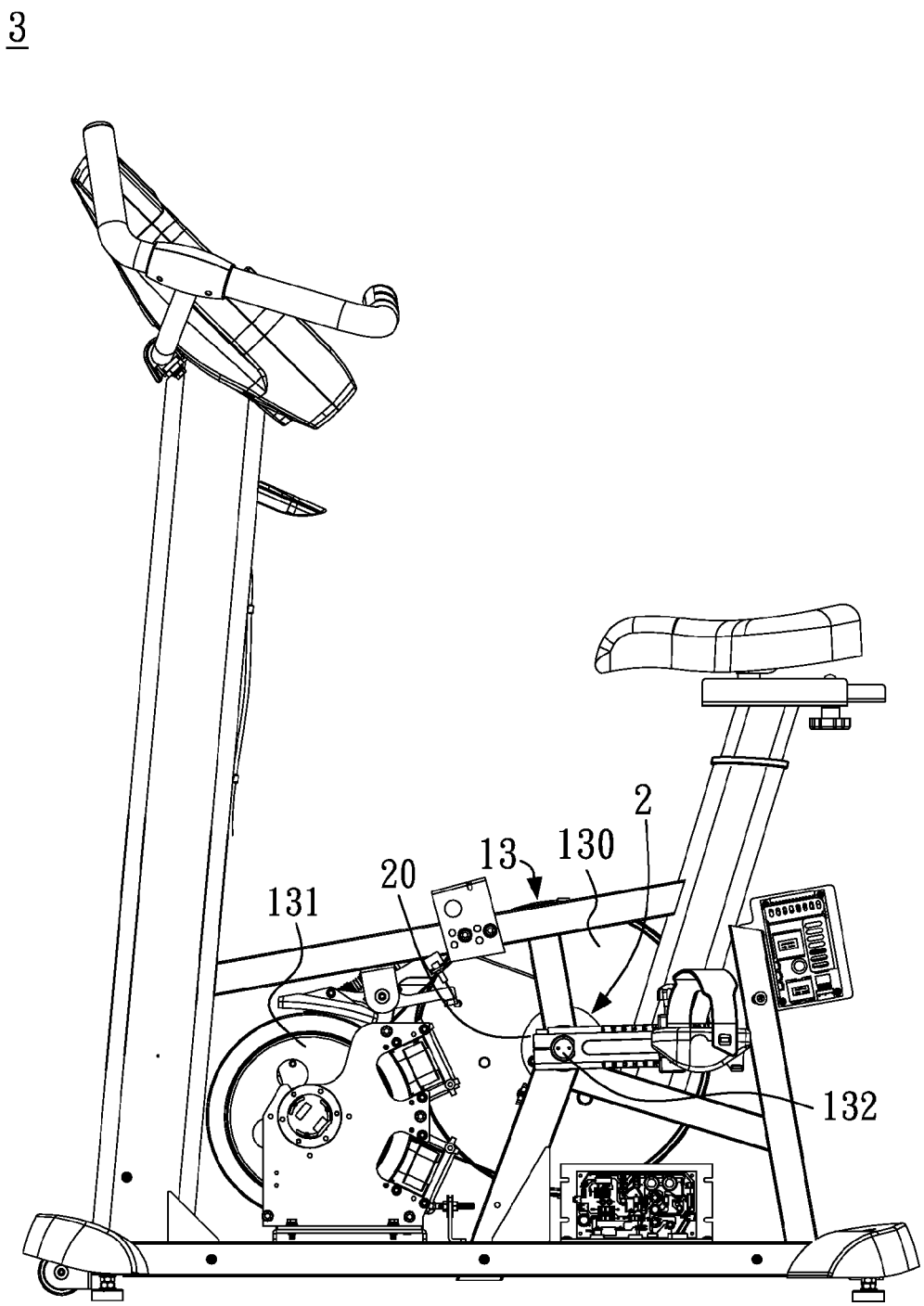
FIG. 8 is a side view showing an exercise machine with a power supplier in accordance with another embodiment of the present invention.

FIG. 8 is perspective view showing an exercise machine 3 according to another embodiment of the present invention. In this embodiment, the exercise machine 3 is a stationary bike, and the power supplier 2 can be arranged at the resistance device 13 of the exercise machine 3.

Preferably the resistance device 13 comprises, but is not limited to, a driving wheel 130 and a magnetic flywheel 131 movably coupled with the driving wheel 130. A user of the exercise machine 3 can exert a force to the driving wheel 130 so as to drive it to rotate. The magnetic flywheel 131 provides an adjustable resistance to the user via the driving wheel 130. In another embodiment, the resistance device 13 may comprise merely a wheel 130 with magnets arranged within or near the wheel 130, so that the wheel 130 itself can provide an adjustable resistance. In this preferred embodiment, the resistance device 13 comprises an axle 132 arranged at the driving wheel 130, and the conducting rings 20 are coaxially coupled with the axle 132, so that the conducting ring 20 can rotate about the axle 132. In another embodiment, the axle 132 is arranged at the magnetic flywheel 131, and the conducting rings 20 are coaxially coupled with the axle 132, so that the conducting ring 20 can rotate about the axle 132. The other details of the conducting ring 20 can be the same of the foregoing embodiments and therefore are omitted for simplicity.

FIG. 9 is a perspective view showing a power supplier in accordance with another embodiment of the present invention. The power supplier comprises two conducting rings 20 respectively arranged at a left side and a right side of the resistance device 13. Each conducting ring 20 comprises a first electrode ring 202 and a second electrode ring 204, such as a positive electrode ring 202 and a negative electrode ring 204, and both of them are made of a conductive material or metal and are electrically connected with the power of the exercise machine 1. The power supplier may comprise two connectors 22, and each connector 22 comprises two contacts 24 respectively contacting the first electrode ring 202 and the second electrode ring 204. Referring to FIGS. 3 and 9, the exercise machine 1 comprises one or more driving mechanism, or one or more sensors or electronic devices needing electricity, and the one or more driving mechanism or one or more sensors or electronic devices are electrically connected with the conducting rings 20 via the connectors 22. The other details of this embodiment are the same as the foregoing embodiments and thus the description are omitted.

Accordingly, the embodiments of this invention provide exercise machines with a power supplier to electrically connect to components or devices in an efficient manner.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise machine, comprising:

a resistance device providing a resistance and comprising an axle;

a power supplier comprising a first conducting ring arranged at a side of the resistance device and a second conducting ring arranged at the side of the resistance device or arranged at another side of the resistance device;

wherein each of the first conducting ring and the second conducting ring coaxially connects with the axle and rotates about the axle and each of the first conducting ring and the second conducting ring comprises a first electrode ring and a second electrode ring.

2. The exercise machine of claim 1, wherein each of the first conducting ring and the second conducting ring further comprises a connector, and the connector comprises two contacts to respectively contact the first electrode ring and the second electrode ring.

3. The exercise machine of claim 1, further comprising two cranks respectively arranged at a side of the resistance device, wherein each crank has an end to couple with the axle, and the crank rotates about the axle when a force is exerted to the crank.

4. The exercise machine of claim 1, wherein the resistance device comprises a driving wheel and a magnetic flywheel.

5. An exercise machine, comprising:

a resistance device providing a resistance and comprising an axle;

two cranks respectively arranged at a side of the resistance device, wherein each crank has an end coupling to the axle;

a power supplier comprising a first conducting ring arranged at a side of the resistance device and a second conducting ring arranged at the side of the resistance device or arranged at another side of the resistance device;

wherein each of the first conducting ring and the second conducting ring coaxially connects with the axle and rotates about the axle, and each of the first conducting ring and the second conducting ring comprises a first electrode ring and a second electrode ring.

6. The exercise machine of claim 5, wherein each of the first conducting ring and the second conducting ring further comprises a connector, and the connector comprises two contacts to respectively contact the first electrode ring and the second electrode ring.

* * * * *